US009757753B2

(12) United States Patent
Tada

(10) Patent No.: US 9,757,753 B2
(45) Date of Patent: Sep. 12, 2017

(54) PUSH-TYPE DISPENSER

(71) Applicant: CANYON CORPORATION, Sanyo Onoda-shi, Yamaguchi (JP)

(72) Inventor: Tetsuya Tada, Tokyo (JP)

(73) Assignee: CANYON CORPORATION, Sanyo Onoda, Yamaguchi (JP)

( * ) Notice: Subject to any disclaimer, the term of this patent is extended or adjusted under 35 U.S.C. 154(b) by 0 days.

(21) Appl. No.: 14/890,382

(22) PCT Filed: May 12, 2014

(86) PCT No.: PCT/JP2014/063137

§ 371 (c)(1),
(2) Date: Nov. 10, 2015

(87) PCT Pub. No.: WO2014/185541

PCT Pub. Date: Nov. 20, 2014

(65) Prior Publication Data

US 2016/0082456 A1 Mar. 24, 2016

(30) Foreign Application Priority Data

May 12, 2013 (JP) ..... 2013-100807

(51) Int. Cl.
*B05B 11/00* (2006.01)

(52) U.S. Cl.
CPC ..... *B05B 11/3004* (2013.01); *B05B 11/3077* (2013.01)

(58) Field of Classification Search
CPC ..... B05B 11/3004; B05B 11/3077; B05B 11/0029; B05B 11/3032; B05B 11/0016; B05B 11/0043; B05B 11/3001
(Continued)

(56) References Cited

U.S. PATENT DOCUMENTS 3,102,489 A * 9/1963 Cooprider ..... B05B 11/0016 137/843
5,016,783 A * 5/1991 Hayes ..... B05B 11/0032 222/153.13
(Continued)

FOREIGN PATENT DOCUMENTS

JP H5-31410 A 2/1993
JP H5-85581 A 4/1993
(Continued)

OTHER PUBLICATIONS

English translation of International Search Report of PCT/JP2014/063137.

*Primary Examiner* — Charles P Cheyney
(74) *Attorney, Agent, or Firm* — Muncy, Geissler, Olds & Lowe, P.C.

(57) ABSTRACT

[Object] To provide a push-type dispenser that is simple in structure and yet capable of surely preventing liquid leakage even when it topples over.
[Solution] A push-type dispenser 100 includes: a cap section 1 that is attachable to a container X containing a liquid; a housing section 2 fixedly fitted in a central portion of the cap section 1; a piston section 3 that is slidable in the housing section 2; a nozzle head section 4 fitted on an upper portion of the piston section 3; a spring section 5 housed in the housing section 2 and configured to bias the nozzle head section 4 upward; a tube section 6 attached to a lower portion of the housing section 2; an F valve A housed in the housing section 2 and configured to open and close a flow channel through which the liquid flows from inside the tube section 6 into the housing section 2; and an S valve B housed in the piston section 3 and configured to open and close a flow channel through which the liquid flows inside of the piston section 3, wherein the liquid is ejected from inside the housing section 2 by moving the nozzle head section 4
(Continued)

downward, the piston section 3 has a through-hole 34, provided in a side surface of the upper portion of the piston section 3, through which the liquid flows, and the through-hole 34 is opened and closed by rotating the nozzle head section 4 circumferentially with respect to the piston section 3.

5 Claims, 7 Drawing Sheets

(58) Field of Classification Search
USPC ..... 222/321.9, 553, 536, 207, 380, 494, 222/326.9
See application file for complete search history.

(56) References Cited

U.S. PATENT DOCUMENTS 5,090,601 A * 2/1992 Thanisch ..... B65D 47/2012 222/507
5,582,315 A * 12/1996 Reid ..... A47G 19/2272 215/389
5,617,976 A * 4/1997 Gueret ..... B05B 11/0029 222/380
6,405,904 B1 * 6/2002 De Laforcade ..... B05B 11/0005 222/182
6,422,425 B1 * 7/2002 Tada ..... B05B 11/3001 222/153.07
6,612,556 B2 * 9/2003 Petrina ..... F16F 1/3665 267/168
6,729,505 B2 * 5/2004 Ramsey et al. ..... B05B 11/3077 222/321.9
6,976,611 B2 * 12/2005 Lee ..... B65D 47/0838 222/536
2003/0057235 A1 * 3/2003 Gueret ..... B65D 1/323 222/182
2005/0184094 A1 * 8/2005 Costa ..... B05B 11/0027 222/153.13
2008/0029550 A1 2/2008 Marelli

FOREIGN PATENT DOCUMENTS

JP H7-144159 A 6/1995
JP 8-71462 A 3/1996
JP 8-84944 A 4/1996
JP 8-182944 A 7/1996
JP 9-290185 A 11/1997
JP H9-303453 A 11/1997
JP 10-235241 A 9/1998
JP 2002-273277 A 9/2002
JP 2003-104468 A 4/2003
JP 2009-208830 A 9/2009

* cited by examiner

PUSH-TYPE DISPENSER

TECHNICAL FIELD

The present invention relates to push-type dispensers and, more particularly, to a push-type dispenser that is simple in structure and yet capable of surely preventing liquid leakage even when it topples over.

BACKGROUND ART

Dispensers have been known as devices for ejecting liquids from inside containers. Among them, a push-type dispenser has been known which is configured such that a liquid is sucked out of a container into a cylinder by moving up and down a nozzle head and pressurized by a piston to be ejected from a nozzle orifice of a nozzle head.

Further, a push-type dispenser has been known which is configured such that a liquid is forced out of a nozzle orifice of a nozzle head by pushing down a piston in a cylinder in conjunction with the pushing in of the nozzle head or such that a liquid is sucked up out of a container into a cylinder by pushing up a piston with the restoring force of a. spring (e.g., see PTLs 1 to 9).

CITATION LIST

Patent Literature

PTL 1: Japanese Patent Application Laid-Open No. 5-31410

PTL 2: Japanese Patent Application Laid-Open No. 5-85581

PTL 3: Japanese Patent Application Laid-Open No. 7-144159

PTL 4: Japanese Patent Application Laid-Open No. 8-71462

PTL 5: Japanese Patent Application Laid-Open No. 8-84944

PTL 6: Japanese Patent Application Laid-Open No. 8-182944

PTL 7: Japanese Patent Application Laid-Open No. 9-290185

PTL 8: Japanese Patent Application Laid-Open No. 10-235241

PTL 9: Japanese Patent Application Laid-Open No. 2002-273277

SUMMARY OF INVENTION

Technical Problem

However, the push-type dispensers disclosed in PTLs 1 to 9 as a whole have the drawbacks of being complex in structure and being large in the number of components.

In particular, they cannot be said to be sufficient in measures to prevent liquid leakage when they topple over.

The present invention has been made in view of these circumstances, and it is an object of the present invention to provide a push-type dispenser that is simple in structure and yet capable of surely preventing liquid leakage even when it topples over.

Solution to Problems

The inventor of the present invention diligently studied in order to solve the problems described above. As a result, the inventors found, surprisingly, that the problems can be solved by a structure in which a through-hole is opened and closed by rotating a nozzle head section circumferentially with respect to a piston section. Thus, the inventor finally accomplished the present invention.

A first aspect of the present invention is directed to a push-type dispenser including: a cap section that is attachable to a container containing a liquid; a housing section fitted in a central portion of the cap section; a piston section that is slidable in the housing section; a nozzle head section fitted on an upper portion of the piston section; a spring section housed in the housing section and configured to bias the nozzle head section upward; a tube section attached to a lower portion of the housing section; an First/F valve housed in the housing section and configured to open and close a flow channel through which the liquid flows from inside the tube section into the housing section; and an Second/S valve housed in the piston section and configured to open and close a flow channel through which the liquid flows inside of the piston section, wherein the liquid is ejected from inside the housing section through the nozzle head section by moving the nozzle head section downward, the piston section has a through-hole, provided in a side surface of the upper portion of the piston section, through which the liquid flows, and the through-hole is opened and closed by rotating the nozzle head section circumferentially with respect to the piston section.

A second aspect of the present invention is directed to the push-type dispenser according to the first aspect, wherein the through-hole is opened by rotating the nozzle head section circumferentially with respect to the piston section so that the through-hole and a flow channel of the nozzle head are in alignment with each other, and the through-hole is closed by rotating the nozzle head section circumferentially with respect to the piston section so that the through-hole and the flow channel of the nozzle head are out of alignment with each other.

A third aspect of the present invention is directed to the push-type dispenser according to the second aspect, wherein the housing section has a protruding portion provided on an outer wall of an upper portion of the housing section, the nozzle head section has a hook portion provided in an inner wall of a lower portion of the nozzle head section, and in a case where the through-hole is closed, the hook portion engages with the protruding portion to restrain the nozzle head section from moving upward and downward.

A fourth aspect of the present invention is directed to the push-type dispenser according to any one of the first to third aspects, wherein the piston section has a first sealing portion provided on a surface of the piston section that is in contact with the nozzle head section, located below the through-hole of the piston section, extended circumferentially, and formed into a raised shape.

A fifth aspect of the present invention is directed to the push-type dispenser according to the fourth aspect, wherein the piston section has a second sealing portion provided on the surface of the piston section that is in contact with the nozzle head section, located below the first sealing portion, extended circumferentially, and formed into a raised shape, the nozzle head section has a groove portion provided therein, and the second sealing portion is fitted in the groove portion.

A sixth aspect of the present invention is directed to the push-type dispenser according to the second aspect, wherein the nozzle head section has a rib formed on a ceiling wall surface between an inner cylindrical portion and an outer cylindrical portion, the spring section has a protrusion formed on an upper ring portion of the spring section, and the through-hole is opened by the rib getting over the protrusion.

A seventh aspect of the present invention directed to the push-type dispenser according to any one of the first to sixth aspects, wherein the spring section has a double-helical structure.

Advantageous Effects of Invention

The push-type dispenser of the present invention is structured such that the piston section has a through-hole, provided in a side surface of the upper portion of the piston section, through which the liquid flows, and such that the through-hole is opened and closed by rotating the nozzle head section circumferentially with respect to the piston section. Therefore, the push-type dispenser of the present invention is simple in structure and yet capable of surely preventing liquid leakage even when it topples over.

For example, the push-type dispenser of the present invention is structured such that the through-hole is opened by rotating the nozzle head section circumferentially with respect to the piston section so that the through-hole and a flow channel of the nozzle head are in alignment with each other, and such that the through-hole is closed by rotating the nozzle head section circumferentially with respect to the piston section so that the through-hole and the flow channel of the nozzle head are out of alignment with each other. This surely causes the through-hole to be closed.

This makes it possible to surely prevent leakage of the liquid even if the push-type dispenser is turned upside down for example by toppling over.

The push-type dispenser of the present invention is structured such that in a case where the through-hole is closed, the hook portion engages with the protruding portion to restrain the nozzle head section from moving upward and downward. This makes it possible to prevent the liquid from being ejected from inside the housing section by the nozzle head section unintentionally moving downward.

The push-type dispenser of the present invention is structured such that the piston section has a first scaling portion provided on a surface of the piston section that is in contact with the nozzle head section, located below the through-hole of the piston section, and formed into a raised shape. Therefore, even if the liquid comes in between the piston section and the nozzle head section, the first sealing portion can suppress leakage of the liquid.

In addition to this, the first sealing portion, which is a small raised portion, makes it easy to rotate the nozzle head section circumferentially with respect to the piston section.

The second scaling portion formed into a raised shape is provided below the first sealing portion, and the second sealing portion is fitted in the groove portion of the nozzle head section. Therefore, even if the liquid comes in beyond the first sealing portion, the second sealing portion can surely prevent leakage of the liquid.

The push-type dispenser of the present invention is structured such drat the nozzle head section has a rib formed on a ceiling wall surface between an inner cylindrical portion and an outer cylindrical portion, such that the spring section has a protrusion formed on an upper ring portion of the spring section, and such that the through-hole is opened by the rib getting over the protrusion. This is makes it possible to see, by feeling impact, that the liquid is ready to be ejected.

The push-type dispenser of the present invention is structured such that the spring section has a double-helical structure. Therefore, the spring section is excellent in spring characteristics and restoring characteristics and is hard to break.

BRIEF DESCRIPTION OF DRAWINGS

FIGS. 3(*b*) is a partially cutaway perspective view for explaining the state in which the nozzle head section has been rotated circumferentially with respect to the piston section in the push-type dispenser according to the present embodiment.

FIG. 6(*b*) is a diagram for explaining the push-type dispenser and is a perspective view of a spring section.

DESCRIPTION OF EMBODIMENTS

Figure 1:
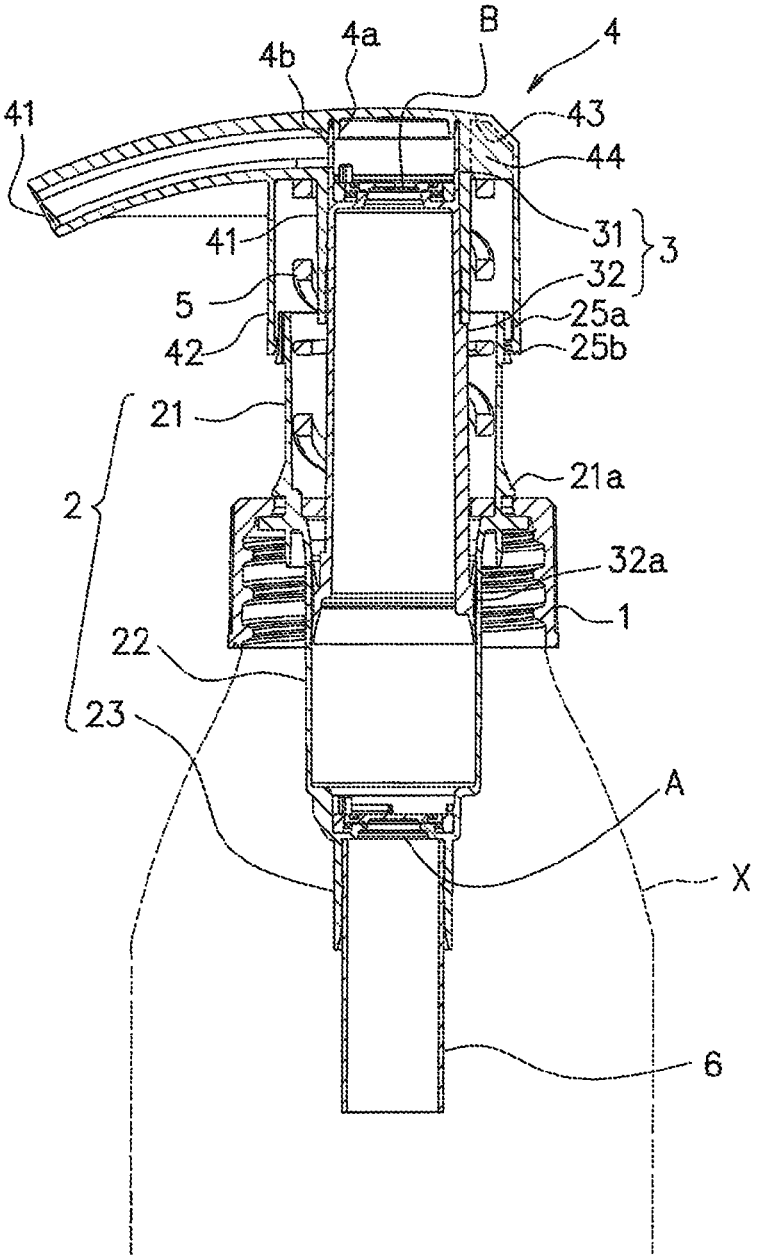
FIG. 1 is a cross-sectional view showing an example of a push-type dispenser according to the present embodiment.

A preferred embodiment of the present invention is described in detail below with reference to the drawings as needed.

In the drawings, the same components are given the same reference signs, and repetition of the same descriptions is omitted.

Further, unless otherwise noted, positional relationships such as top and bottom, left and right are based on those shown in the drawings.

Furthermore, the dimensional ratios of the drawings are not limited to those shown in the drawings.

FIG. 1 is a cross-sectional view showing an example of a push-type dispenser according to the present embodiment.

As shown in FIG. 1, a push-type dispenser 100 includes: a cap section 1 that is attachable to a container X containing a liquid; a housing section 2 fixedly fitted in a central portion of the cap section 1; a piston section 3 that is slidable in the housing section 2; a nozzle head section 4 fitted nu an upper portion of the piston section 3; a spring section 5 housed in the housing section 2 and configured to bias the nozzle head section 4 upward; a tube section 6 attached to a lower portion of the housing section 2; an First/F valve A housed in the housing section 2 and configured to open and close a flow channel through which the liquid flows from inside the tube section 6 into the housing section 2; and an Second/S valve B housed in the piston section 3 and configured to open and close a flow channel through which the liquid flows inside of the piston section 3.

The container X used here is an appropriate well-known container that is attachable to the cap section 1, and is not limited to any particular shape.

Further, the liquid that the container X contains is not limited to any particular composition, and may take the form of foam or gel instead of taking the form of liquid, provided it can be ejected.

The push-type dispenser 100 is fixed to the container X by screwing the cap section 1 onto a mouth portion of the container X.

It should be noted that the cap section 1 may be fixed by locking instead of being fixed by screwing.

The cap section 1 has a hole provided in its central portion, and the housing section 2 is fitted in the hole.

Moreover, the housing section 2 has a fitting portion 21*a* provided on a central outer wall of the housing section 2. The housing section 2 is fixed to the cap section 1 by fitting the fitting portion 21*a* into the cap section 1.

The housing section 2 is cylindrical. The housing section 2 includes a lower housing portion (i.e., the lower portion of the housing section) 23 to which the after-mentioned tube section 6 is attachable, a middle housing portion (i.e., a middle portion of the housing section) 22 formed in continuity with the lower housing portion 23, and an upper housing portion (i.e., the upper portion of the housing section) 21 formed in continuity with the middle housing portion 22.

The lower housing portion 23 is smaller in diameter than the middle housing portion 22, and the upper housing portion 21 is larger in diameter than the middle housing portion 22.

That is, the housing section 2 is stepped so that the lower housing poi on 23 is larger in diameter than the middle housing portion 22 and the middle housing portion 22 is larger in diameter than the upper housing portion 21.

The lower housing portion 23 is configured such that the tube section 6 is attachable to the lower housing portion 23.

It should be noted that the tube section 6 can be integrated with the lower housing portion 23.

Further, the tube is not limited to any particular shape or material.

This causes the liquid to be introduced from inside the container X into an internal space of the lower housing section 23 via the tube section 6.

The middle housing portion 22 has an internal space in which the liquid is stored.

Further, the First/F valve A is provided between the internal space of the middle housing portion 22 and the internal space of the lower housing portion 23.

That is, the First/F valve A is housed in the housing section 2, and has a function of opening and closing the flow channel through which the liquid flows from inside the tube section 6 into the housing section 2.

This causes the liquid, which has been introduced into the internal space of the lower housing portion 23, to pass through the First/F valve A to reach and be stored in the internal space of the middle housing portion 22.

Furthermore, the middle housing portion 22 has an inner wall along which the piston section 3 slides.

That is, the middle housing portion 22 serves as a so-called cylinder for the piston section 3.

It should be noted that the piston section 3 will be described later.

The upper housing portion 21 houses the spring section 5 and the piston section 3.

Specifically, the spring section 5 is placed around the piston section 3 in such a manner as to surround the piston section 3.

It should be noted that the aforementioned fitting portion 21*a* is provided on the outer wall substantially at a boundary division between the middle housing portion 22 and the upper housing portion 21.

The spring section 5 has a function of biasing the after-mentioned nozzle head section 4 upward.

Figure 2:
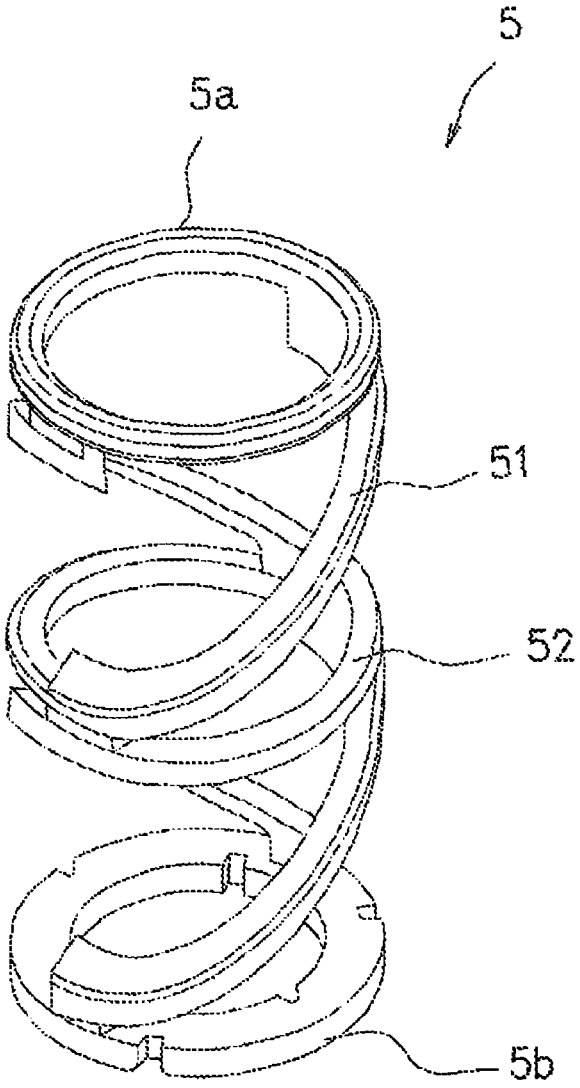
FIG. 2 is a perspective view showing an example of a spring section of the push-type dispenser according to the present embodiment.

FIG. 2 is a perspective view showing an example of the spring section of the push-type dispenser according to the present embodiment.

As shown in FIG. 2, the spring section 5 has a double-helical structure.

That is, the helical portion 51 and the helical portion 52 are provided between the upper ring portion 5*a* and the lower ring portion 5*b*. The helical portion 51 and the helical portion 52 are out of phase with each other by 180 degrees.

Note here that the helical portion 51 and the helical portion 52 of the spring section 5 are both variable in pitch with partially different angles of inclination.

Specifically, the helical portion 51 and the helical portion 52 are steeply inclined from the upper part to the middle part, mildly inclined near the middle part, and steeply inclined again from the middle part to the lower part.

Further, the helical portion 51 and the helical pot on 52, are joined at two places near the center.

This structure gives the spring section 5 the advantages of being excellent in spring characteristics and restoring characteristics and being hard to break.

Further, the spring section 5 is stable in axis line and thus efficiently exerts spring force.

Furthermore, even if one of the helical portions of the spring section 5 is broken, the other helical portion can exert spring force.

With continued reference to FIG. 1, the piston section 3, which is cylindrical, includes a body portion 32 and a head portion 31 formed in the upper portion in continuity with the body portion 32, The body portion 32 has a tongue 32*a* that is slidable on the inner wall of the aforementioned middle housing portion 22.

The piston section 3 is attached to the housing section 2 by press-fitting the body portion 32 into the middle housing portion 22.

Further, the Second/S valve B is provided between an internal space of the body portion 32 of the piston section 3 and an internal space of the head portion 31 of the piston section 3.

That is, the Second/S valve B is housed in the piston section 3, and has a function of opening and closing a flow channel through which the liquid flows from inside the body portion 32 into the head portion 31.

Further, the head nozzle section 4 is fixedly press-fitted on the upper portion of the piston section 3.

Specifically, the nozzle head section 4 is fitted on a portion of the piston section 3 that extends from the head portion 31 to the body portion 32.

The nozzle head section 4 has a ringed rib 4*a* provided therein.

Therefore, the upper portion of the piston section 3 is fitted in between the ringed rib 4*a* and a wall portion 4*b*. The ringed rib 4*a* and the wall portion 4*b* are provided on the uppermost ceiling wall surface of the nozzle head section 4.

This allows the piston section 3 to be surely sealed with respect to the nozzle head section 4.

Figure 3B:
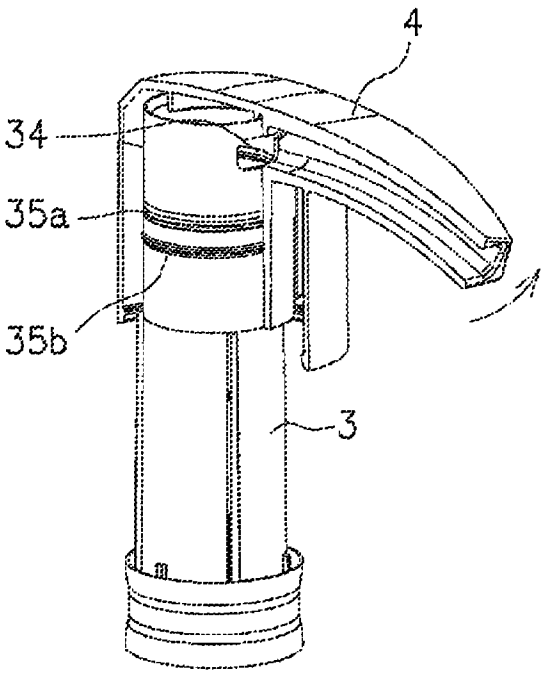
FIGS. 3(*a*) is a partially cutaway perspective view for explaining a state in which a nozzle head section has been rotated circumferentially with respect to a piston section in the push-type dispenser according to the present embodiment.
Figure 3A:
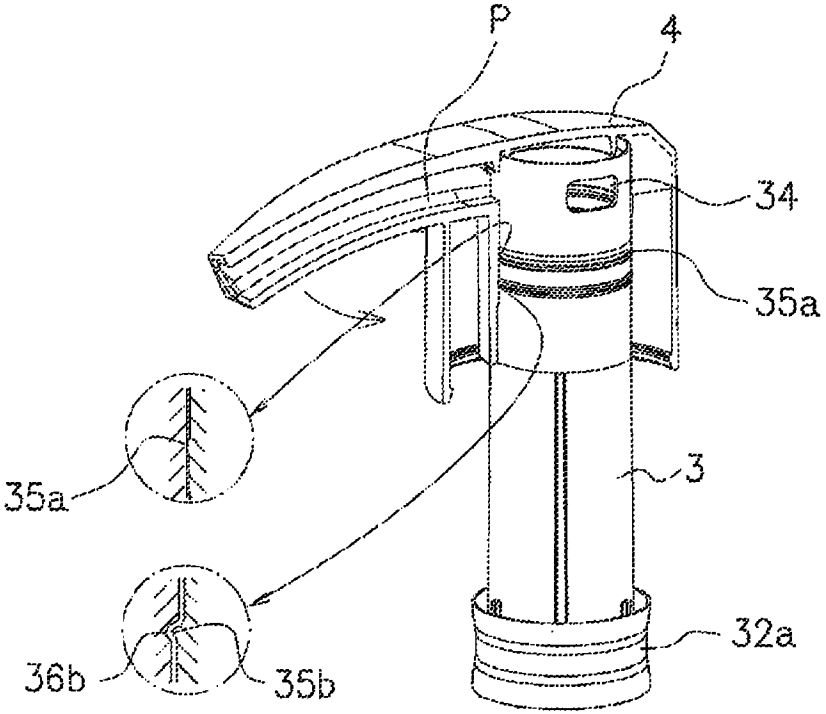

FIGS. 3(*a*) and FIGS. 3(*b*) are partially cutaway perspective views for explaining a state in which the nozzle head section has been rotated circumferentially with respect to the piston section in the push-type dispenser according to the present embodiment.

As shown in FIG. 3(*a*), the push-type dispenser 100 is configured such that the piston section 3 has a through-hole 34, provided in a side surface of the upper portion of the piston section 3, through which the liquid flows.

In the case of the state shown in FIG. 3(*a*), the through-hole 34 and a flow channel P of the nozzle head section 4 are out of alignment with each other, with the result that the through-hole 34 is closed.

Rotating the nozzle head section 4 circumferentially with respect to the piston section 3 causes the through-hole 34 and the flow channel of the nozzle head section 4 to be in alignment with each other as shown in FIG. 3(*b*), with the result that the through-hole 34 is opened.

Thus, the push-type dispenser 100 according to the present embodiment is configured such that the through-hole 34 can be opened and closed simply by rotating the nozzle head section 4 circumferentially with respect to the piston section 3.

Therefore, the push-type dispenser 100 is simple in structure and yet capable of surely preventing liquid leakage even when it topples over.

Further, as shown in FIG. 3(*a*), the push-type dispenser 100 according to the present embodiment is configured such that the piston section 3 has a first sealing portion 35*a* provided on a surface of the piston section 3 that is in contact with (i.e., is pressed against) the nozzle head section 4, located below the through-hole 34 of the piston section 3, extended circumferentially, and formed into a raised shape.

For this reason, even if the liquid comes in between the piston section 3 and the nozzle head section 4, the first scaling portion 35*a* can suppress leakage of the liquid.

It should be noted that since the first sealing portion 35*a* is a very small raised portion, it hardly forms a gap between the piston section 3 and the nozzle head section 4.

Further, the provision of the first sealing portion reduces a coefficient of friction, thus making it easy to rotate the nozzle head section 4 circumferentially with respect to the piston section 3.

In addition to this, the push-type dispenser 100 according to the present embodiment is configured such that the piston section 3 has a second sealing portion 35*b* provided on the surface of the piston section 3 that is in contact with the nozzle head section 4, located below the aforementioned first sealing portion 35*a*, extended circumferentially, and formed into a raised shape.

Meanwhile, the nozzle head section 4 has a groove portion 36*b* provided therein, and the second sealing portion 35*b* is fitted in the groove portion 36*b*.

For this reason, even if the liquid comes in beyond the first sealing portion 35*a*, the second sealing portion 35*b* can surely prevent leakage of the liquid.

Figure 4:
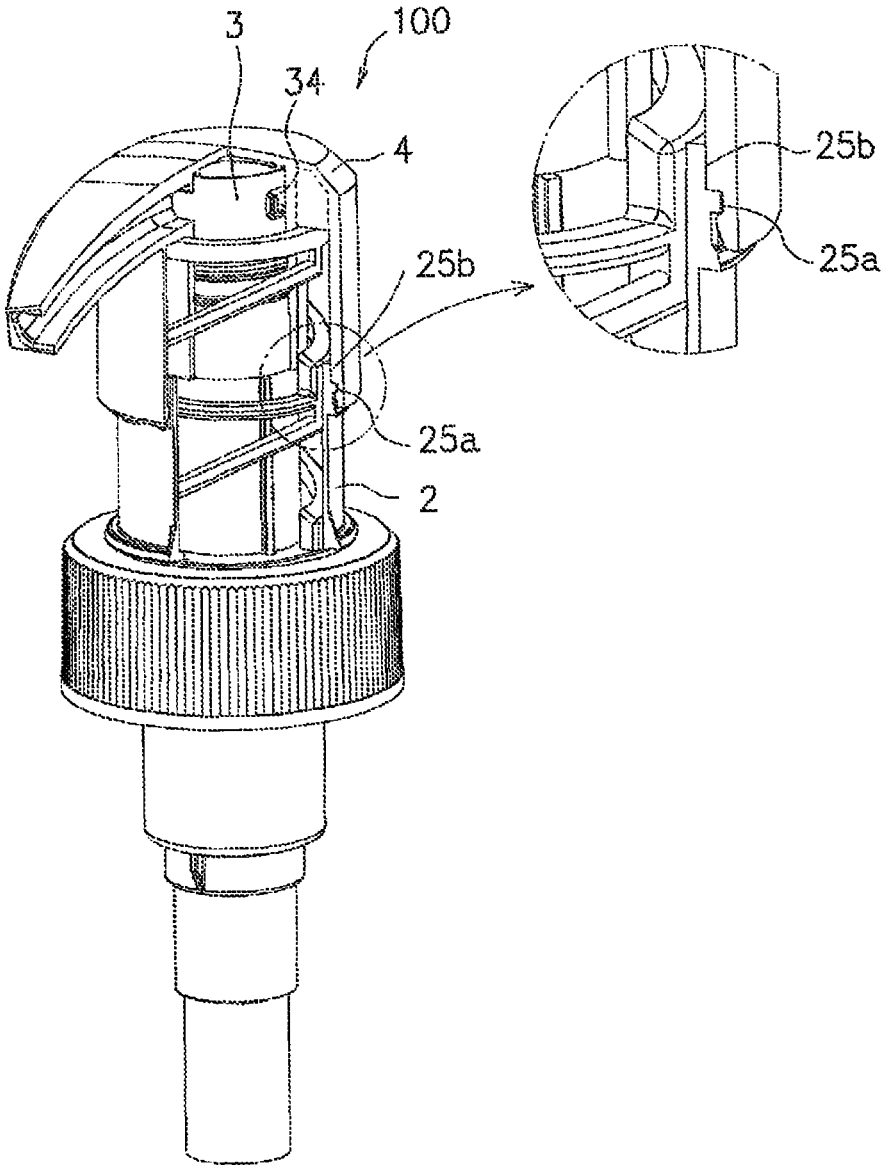
FIG. 4 is a partially cutaway perspective view for explaining a state in which a hook portion and a protruding portion in the push-type dispenser according to the present embodiment engage with each other FIG. 5(*a*) is a cross-sectional view showing a state in which a through-hole of the push-type dispenser according to the present embodiment is open.

FIG. 4 is a partially cutaway perspective view for explaining a state in which a hook portion and a protruding portion in the push-type dispenser according to the present embodiment engage with each other.

As shown in FIGS. 1 and 4, the push-type dispenser 100 is configured such that the housing section 2 has a protruding portion 25*a* provided on an outer wall of the upper portion of the housing section 2.

Meanwhile, the nozzle head section 4 has a hook portion 25*b* provided in an inner portion of a lower portion of the nozzle head section 4.

Moreover, as mentioned above, in a case where the through-hole 34 is closed by rotating the nozzle head section 4 with respect to the piston section 3, the hook portion 25*b* engages with the protruding portion 25*a*. This restrains the nozzle head section 4 from moving upward and downward.

The push-type dispenser 100 is configured such that in a case where the through-hole 34 is closed, the hook portion 25*b* engages with the protruding portion 25*a*.

This restrains the nozzle head section 4 from moving upward and downward, thus making it possible to prevent the liquid from being forcibly ejected from inside the housing section 2 by the nozzle head section 4 unintentionally moving downward with the through-hole 34 in a closed state.

The following describes how the push-type dispenser 100 according to the present embodiment works.

Figure 5B:
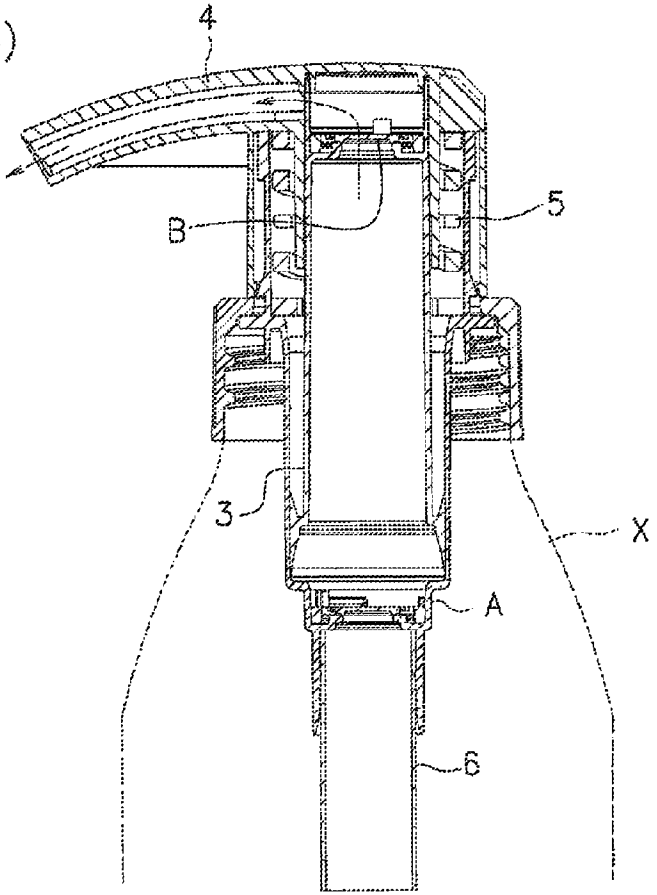
FIG. 5(*b*) is a cross-sectional view showing a state in which the nozzle head section has been moved downward from the state shown in FIG. 5(*a*).
Figure 5A:
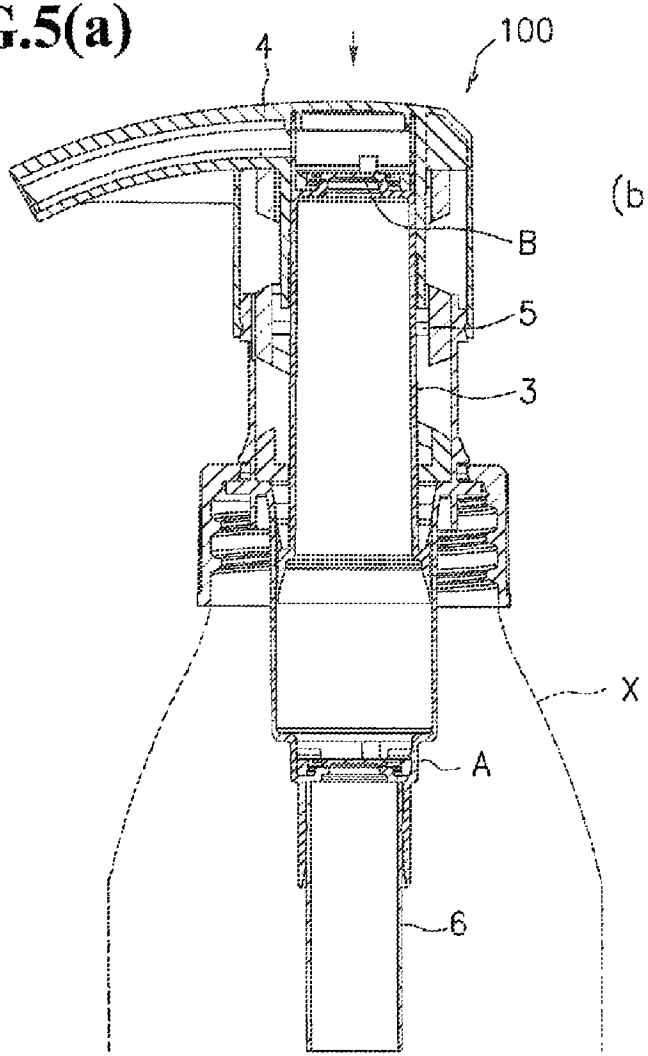

FIG. 5(*a*) is a cross-sectional view showing a state in which the through-hole of the push-type dispenser according to the present embodiment is open. FIG. 5(*b*) is a cross-sectional view showing a state in which the nozzle head section has been moved downward from the state shown in FIG. 5(*a*).

As shown in FIG. 5(*a*), the push-type dispenser 100 is configured such that by pressing the nozzle head section 4 so that the nozzle head section 4 moves downward, the First/F valve A is closed and the liquid stored in the housing section 2 is pressurized by the piston section 3.

This causes the Second/S valve B to be opened by the pressure of the liquid, so that as shown in FIG. 5(*b*), the liquid flows from inside the piston section 3 into the nozzle head section 4 to be ejected from a nozzle orifice of the nozzle head section 4.

Meanwhile, when the nozzle head section 4 is released from the state, the biasing force of the spring section 5 causes the nozzle head section 4 to move upward and places the housing section 2 under negative pressure. This causes the liquid to be sucked up out of the container X into the tube section 6 and the First/F valve A opens, so that the in-cylinder space is refilled with the liquid.

Thus, the nozzle head section 4 is brought back into the state shown in FIG. 5(*a*).

The following describes an example in which the aforementioned push-type dispenser 100 includes a sensing function as an additional function.

Figure 6A:
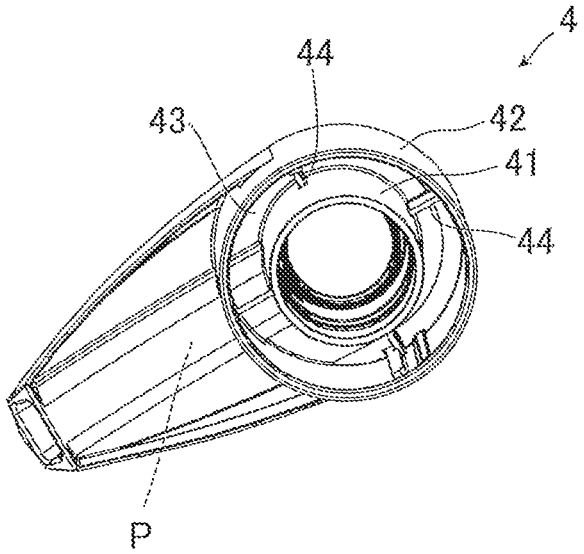
FIG. 6(*a*) is a diagram for explaining a push-type dispenser including a sensing function and is a perspective view of a nozzle head section.
Figure 6B:
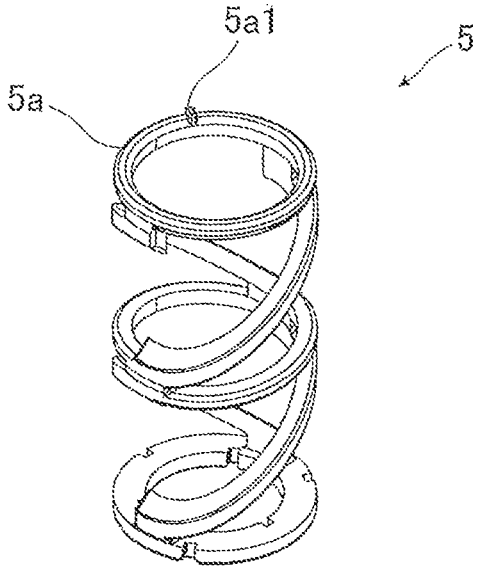

FIG. 6(*a*) is a diagram for explaining a push-type dispenser 100 including a sensing function and is a perspective view of a nozzle head section. FIG. 6(*b*) is a diagram for explaining the push-type dispenser 100 and is a perspective view of a spring section.

Structuring the nozzle head section 4 and the spring section 5 as shown in the drawings generates a feeling of impact just before the flow channel P of the nozzle head section 4 is aligned with the through-hole 34 of the piston section 3 by rotating the nozzle head section 4 (sensing function).

That is, the nozzle head section 4 has a rib 44 formed on a ceiling wall surface 43 between an inner cylindrical portion 41 and an outer cylindrical portion 42; meanwhile, the spring section 5 has a protrusion 5*a*1 formed on the upper ring portion 5*a*.

The rib 44 of the nozzle head section 4 includes a plurality of ribs 44 to reinforce the inner cylindrical portion 41 and the outer cylindrical portion 42, and the sensing function is achieved by utilizing this.

Further, the protrusion 5*a*1 on the upper ring portion 5*a* of the spring section 5 is provided so as to correspond in position to a rib 44 of the nozzle head section 4 in a state where the spring section 5 has been incorporated. For example, a state in which an inlet of the flow channel P of the nozzle head section 4 has come to the front to be in alignment with the through-hole 34 of the piston section 3 is a state in which the liquid can be ejected.

Moreover, the rib 44 of the nozzle head section 4 is provided in a position at an angle of substantially 90 degrees from the flow channel P.

In a state where the spring section 5 has been incorporated, the protrusion 5*a*1 of the spring section 5 is in a position at an angle of substantially 90 degrees from the through-hole 34 of the piston section 3 and corresponds in position to the rib 44 of the nozzle head section 4.

Now, let it be assumed that the nozzle head section 4 is rotated to the front from a state n which the through-hole 34 is closed (i.e., a state in which the flow channel P and the through-hole 34 are out of alignment with each other).

The nozzle head section 4 is rotated, and the flow channel P comes immediately in front of the through-hole 34 of the piston section 3.

Then, the rib 44 of the nozzle head section 4 hits the protrusion 5*a*1 of the spring section 5.

Further rotating the nozzle head section 4 causes the rib 44 of the nozzle head section 4 to get over the protrusion 5*a*1 of the spring section 5.

After the rib 44 of the nozzle head section 4 has gotten over the protrusion 5*a*1 of the spring section 5, the flow channel P and the through-hole 34 are in alignment with each other to bring about a state in which the liquid can be ejected (i.e., a state in which the through-hole 34 is open).

The small impact of the rib 44 hitting and getting over the protrusion 5*a*1 is imparted as a tactile feeling to a hand to effect a so-called "click feel" or "crisp feel".

Therefore, a user of the push-type dispenser 100 can easily and tactilely feel, without seeing in which direction the nozzle faces, whether the liquid is ready to be ejected from the nozzle.

The foregoing has described a preferred embodiment of the present invention. However, the present invention is not limited to the embodiment described above.

For example, although the push-type dispenser according to the present embodiment is configured such that the spring section 5 has a double-helical structure, this does not imply any limitation.

The push-type dispenser according to the present embodiment includes the first sealing portion 35*a* and the second sealing portion 35*b*. However, the push-type dispenser according to the present embodiment does not necessarily need to include the first scaling portion 35*a* and a second sealing portion 35*b*. The push-type dispenser according to the present embodiment may include only either the first sealing portion 35*a* or the second sealing portion 35*b*.

Further, it is possible to employ an First/F valve having a different type of structure from the aforementioned First/F valve.

Figure 7:
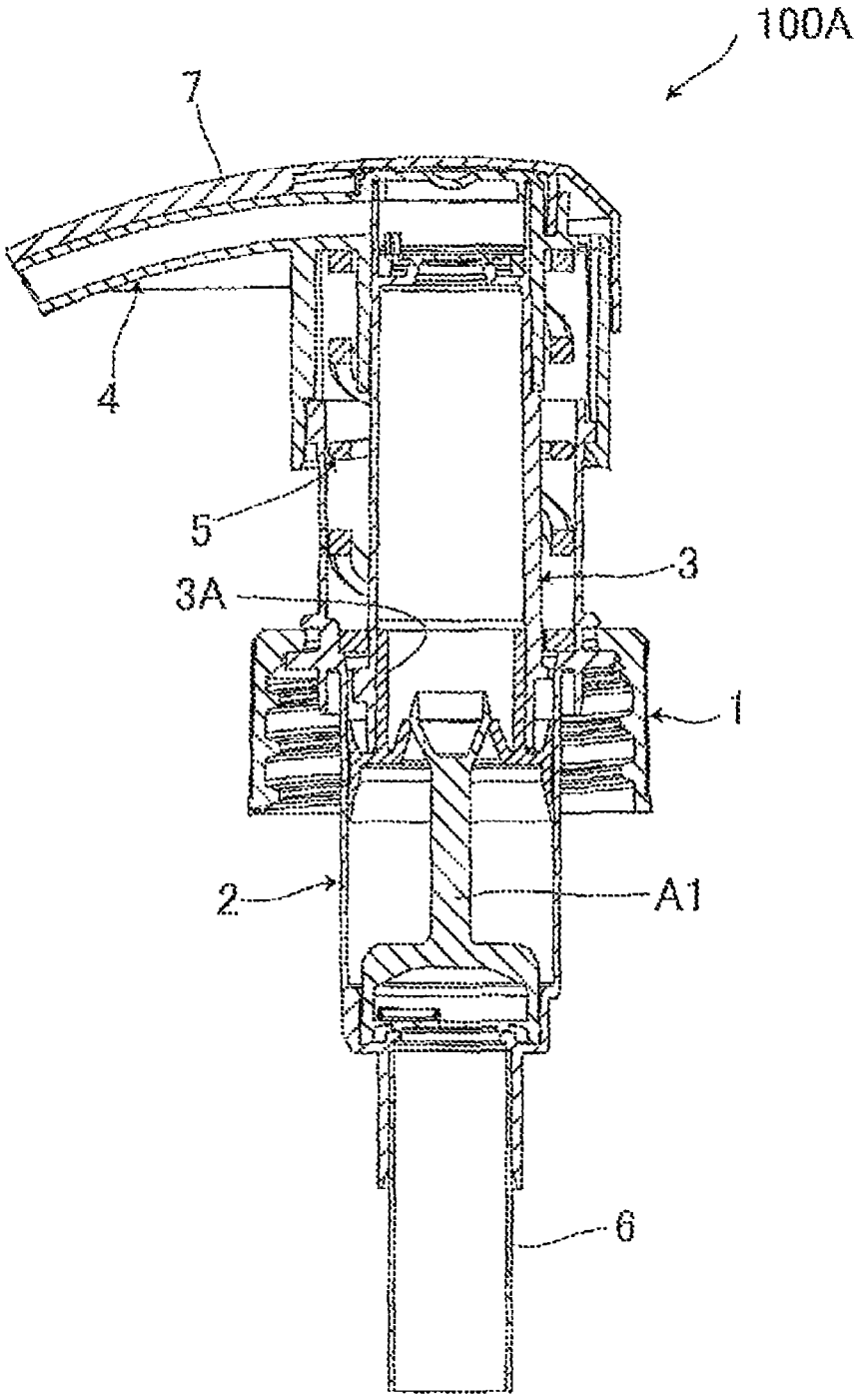
FIG. 7 shows a push-type dispenser employing an First/F valve of a different structure.

FIG. 7 shows a push-type dispenser 100A employing an First/F valve of a different structure, In this example, the First/F valve A1 is structured to have a valve disc corresponding to a sealing valve seat of the piston section 3.

Moreover, the piston section 3 is divided into separate parts one of which is a part including the sealing valve seat.

Further, the nozzle head section 4 is covered with a nozzle head cover 7.

INDUSTRIAL APPLICABILITY

A push-type dispenser of the present invention is suitably used as a device for ejecting a liquid from inside a container by moving up and down a nozzle head.

The push-type dispenser of the present invention is simple in structure and yet capable of surely preventing liquid leakage even when it topples over.

REFERENCE SIGNS LIST

1 . . . Cap section
2 . . . Housing section
21 . . . Upper housing portion
21*a* . . . Fitting portion
22 . . . Middle housing portion
23 . . . Lower housing portion
25*a* . . . Protruding portion
25*b* . . . Hook portion
3 . . . Piston section
31 . . . Head portion
32 . . . Body portion
32*a* . . . Tongue
34 . . . Through-hole
35*a* . . . First sealing portion
35*b* . . . Second sealing portion
36*b* . . . Groove portion
4 . . . Nozzle head section
41 . . . Inner cylindrical portion
42 . . . Outer cylindrical portion
43 . . . Ceiling wall surface
44 . . . Rib
4*a* . . . Ringed rib
4*b* . . . Wall portion
5 . . . Spring section
5*a* . . . Upper ring portion
5*a*1 . . . Protrusion
5*b* . . . Lower ring portion
51, 52 . . . Helical portion
6 . . . Tube section
100, 100A . . . Push-type dispenser
A . . . First/F valve
A1 . . . First/F valve
B . . . Second/S valve
P . . . Flow channel
X . . . Container

The invention claimed is:

1. A push-type dispenser comprising:

a cap section that is attachable to a container containing a liquid;

a housing section fitted in a central portion of the cap section;

a piston section that is slidable in the housing section;

a nozzle head section fitted on an upper portion of the piston section;

a spring section housed in the housing section and configured to bias the nozzle head section upward;

a tube section attached to a lower portion of the housing section;

a first valve housed in the housing section and configured to open and close a flow channel through which the liquid flows from inside the tube section into the housing section; and a second valve housed in the piston section and configured to open and close a flow channel through which the liquid flows inside of the piston section, wherein the liquid is ejected from inside the housing section through the nozzle head section by moving the nozzle head section downward, the piston section has a through-hole, provided in a side surface of the upper portion of the piston section, through which the liquid flows, the through-hole is opened and closed by rotating the nozzle head section circumferentially with respect to the piston section, the through-hole is opened by rotating the nozzle head section circumferentially with respect to the piston section so that the through-hole and a flow channel of the nozzle head are in alignment with each other, and the through-hole is closed by rotating the nozzle head section circumferentially with respect to the piston section so that the through-hole and the flow channel of the nozzle head are out of alignment with each other, and the nozzle head section has a rib formed on a ceiling wall surface between an inner cylindrical portion and an outer cylindrical portion, the spring section has a protrusion formed on an upper ring portion of the spring section, and the through-hole is opened by the rib getting over the protrusion.

2. The push-type dispenser according to claim 1, wherein the housing section has a protruding portion provided on an outer wall of an upper portion of the housing section, the nozzle head section has a hook portion provided in an inner wall of a lower portion of the nozzle head section, and in a case where the through-hole is closed, the hook portion engages with the protruding portion to restrain the nozzle head section from moving upward and downward.

3. The push-type dispenser according to claim 1, wherein the piston section has a first sealing portion provided on a surface of the piston section that is in contact with the nozzle head section, located below the through-hole of the piston section, extended circumferentially, and formed into a raised shape.

4. The push-type dispenser according to claim 3, wherein the piston section has a second sealing portion provided on the surface of the piston section that is in contact with the nozzle head section, located below the first sealing portion, extended circumferentially, and formed into a raised shape, the nozzle head section has a groove portion provided therein, and the second sealing portion is fitted in the groove portion.

5. The push-type dispenser according to claim 1, wherein the spring section has a double-helical structure.

* * * * *